United States Patent [19]

Jordan

[11] 4,189,029

[45] Feb. 19, 1980

[54] SCAFFOLD DEVICE

[76] Inventor: Henry W. Jordan, 4400 Robertson Pl., Bridgeton, Mo. 63042

[21] Appl. No.: 940,016

[22] Filed: Sep. 6, 1978

[51] Int. Cl.[2] ..... E04G 3/02; E04G 5/06

[52] U.S. Cl. ..... 182/179; 182/120; 182/229; 182/230

[58] Field of Search ..... 182/117, 82, 214, 123, 182/122, 179; 248/235, 238, 210, 240.4, 220.2, 221, 222.1

[56] References Cited

U.S. PATENT DOCUMENTS

| | | | |
|---|---|---|---|
| 652,010 | 6/1900 | Wheeler | 182/121 |
| 921,431 | 5/1909 | Miller | 182/230 |
| 4,078,633 | 3/1978 | Fahy | 182/82 |

FOREIGN PATENT DOCUMENTS

| | | | |
|---|---|---|---|
| 1,363,224 | 8/1974 | United Kingdom | 182/121 |

*Primary Examiner*—Reinaldo P. Machado
*Attorney, Agent, or Firm*—Rogers, Eilers & Howell

[57] ABSTRACT

A scaffold device has two leg members having at their upper end spacers to space the legs away from a wall or other structure. Each leg has a support assembly for a platform upon which a worker may stand. The support assemblies comprise a pair of sleeves which can be adjustably secured to the legs, and a pair of rods each having one end pivotally secured relative to their corresponding sleeves, with the other rod ends having lock holes to permit the rod ends to be secured at a position to support the platform level with the ground for safe operation. A cross rail connects each of the legs and acts to maintain the relative position of the legs and also acts as a safety device to prevent workers from falling off the scaffold. The legs, at their lower ends, have adjustable extendors which allow the overall height of the scaffold to be decreased and increased, and allows for one leg assembly to be of greater height than another assembly to accommodate different levels in terrain upon which the scaffold is mounted. The legs, extendors, and platform are made of rectangular supporting members such as wooden beams and can utilize two by four inch wood and two by eight inch wood, (5.08 cm× 10.16 cm and 5.08 cm×20.32 cm).

9 Claims, 7 Drawing Figures

3
3
146
29
142
152
138
29
22
160
6
4
4
29
80
94
130
98
84
109
90
105
29
128
5
5
132
134
112
62
74
120
126
129
78
66
58
110
107
26
6
48
40
29
7
7
10
36
44
26
12
152
150
138
142
154
146
22
14
148
150
152
154
140
144
24
10
98
102
100
80
82
134
64
68
60
42
50
28
24
46
38
28

FIG. 3.
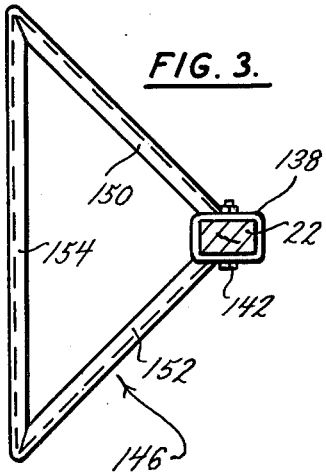
FIG. 4.
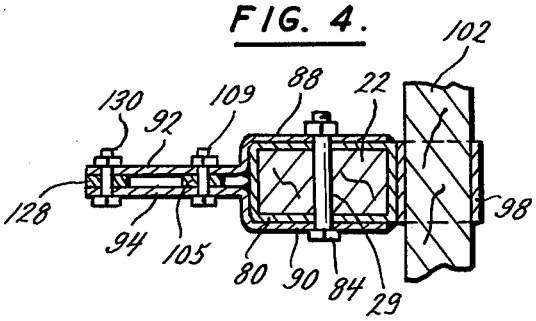
FIG. 5.
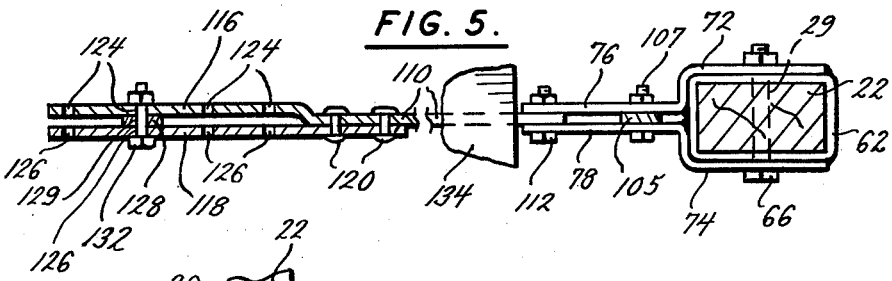
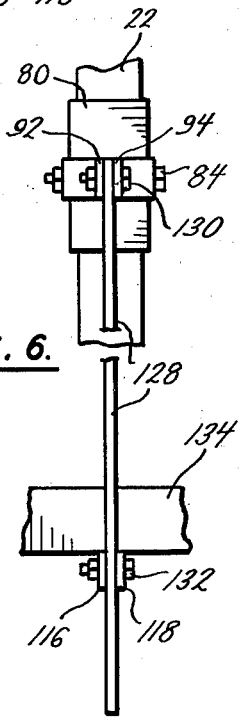
FIG. 6.
FIG. 7.
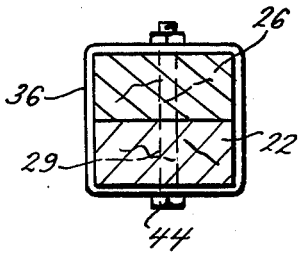

SCAFFOLD DEVICE

BACKGROUND AND SUMMARY OF THE INVENTION

The present invention is concerned with scaffolds used to support workers next to structures upon which the workers must operate. It is more specifically concerned with a scaffold which comprises a minimum of structural members yet allows great maneuverability for the workers. In the prior art there have been scaffolds used to perform construction work. One such device is a ladder jack. The ladder jack generally comprises a pair of ladders which are spaced apart from one another and which lean against a wall or the like upon which work is to be performed. The ladder jack is placed upon two rungs of each of the ladders to support a walking plank at a position on the outside of the ladders from the wall. The ladder jack thus utilizes two ladders and does not place the operator at a position near the wall.

Other scaffolds simply provide for support of a plank or the like, but do not provide necessary height, or variation in height that is desired, nor do they provide safety features necessary. The scaffolds do not provide the maneuverability and structural range necessary, and do not obtain maximum utilization of the material used in the structure.

The present invention improves over the prior art. The present invention comprises an adjustable scaffold having two longitudinal leg assemblies each having a longitudinal leg and an upper end spacer of triangular shape which spaces the upper leg ends away from the wall upon which construction work, painting, or the like is desired to be performed. These spacers are adjustable relative to the legs by virtue of a plurality of lock bores spaced along the legs, and lock bores in the sleeves of the triangular spacers which allow locking of the spacers in place relative to the legs.

The novel scaffold has a pair of platform support assemblies, each assembly comprising a pair of sleeves which telescopically receive the legs and are adjustably secured to the legs by bolts extending through the sleeves and through the leg bores. Each pair of platform assembly sleeves has a connecting rod which keeps the sleeves equidistantly spaced and provides rigidity. Each platform assembly has two other rods which are pivotally secured relative to each of the sleeves. In the secured position, the upper pivotal rod extends downwardly from the upper platform assembly sleeve while the lower rod extends transversely outwardly from the scaffold legs with the two rods connected by bolts extending through selected bores of a plurality of bores at the ends of the rods. The lower rod thus can be adjustably positioned so that it is approximately level with the ground upon which the scaffold is mounted. The walking platform, which is formed of two by eight inch board is supported by the lower rod to allow workers to walk upon it and to be near the wall upon which they are working.

The platform support assemblies have a cross rail which telescopically extends through a pair of transversely oriented sleeves secured to each of the top sleeves of the platform assemblies. The cross rail provides for a hand hold for the workers and also prevents them from falling backward off the walking platform.

At the lower end of the scaffold legs are a pair of adjustable extendor members which can be slid relative to the legs and locked thereto by bolts extending through telescopic sleeves, the extendors and the legs. This allows variance in the overall length of the leg assembly.

The scaffold can thus be operated by placing the leg members with the triangular spacers against the wall to keep the upper ends outward from the wall and thus provides greater maneuverability. The positioning of the platform assemblies on the inside of the legs allows the worker to get close to the wall to do the necessary work desired. The adjustable nature of the platform support allows the platform to be always positioned level to the ground so that the workers will not be working upon a a sloped surface. The handrails provide a hand hold and safety bar to prevent the falling of the workers off the platform and also serves a means to hang equipment and tools upon at a convenient height relative to the workers. The extendors allow increasing and decreasing the height of the scaffold to the height desired and also allow differences in length of the leg assemblies to accommodate discrepancies in the level of the terrain.

DESCRIPTION OF THE DRAWINGS

FIG. 3 is a top section view of one of the scaffold leg assemblies taken on the line 3—3 of FIG. 1 showing a triangle spacer brace and its sleeve;

FIG. 4 is a section of a leg assembly taken on the line 4—4 of FIG. 1 showing a top part of a platform support assembly structure with the crossrail being shown broken;

FIG. 5 is a section taken on the line 5—5 of FIG. 1 showing a view of a lower part of the platform support assembly with some parts being shown broken;

FIG. 6 is a view of part of a platform support assembly taken on the line 6—6 of FIG. 1 with some parts being shown broken; and FIG. 7 is a section of the lower part of a leg assembly taken on the line 7—7 of FIG. 1 showing a leg and an extendor secured by a sleeve, nut and bolt.

DESCRIPTION OF THE PREFERRED EMBODIMENT

Figures 1, 2:
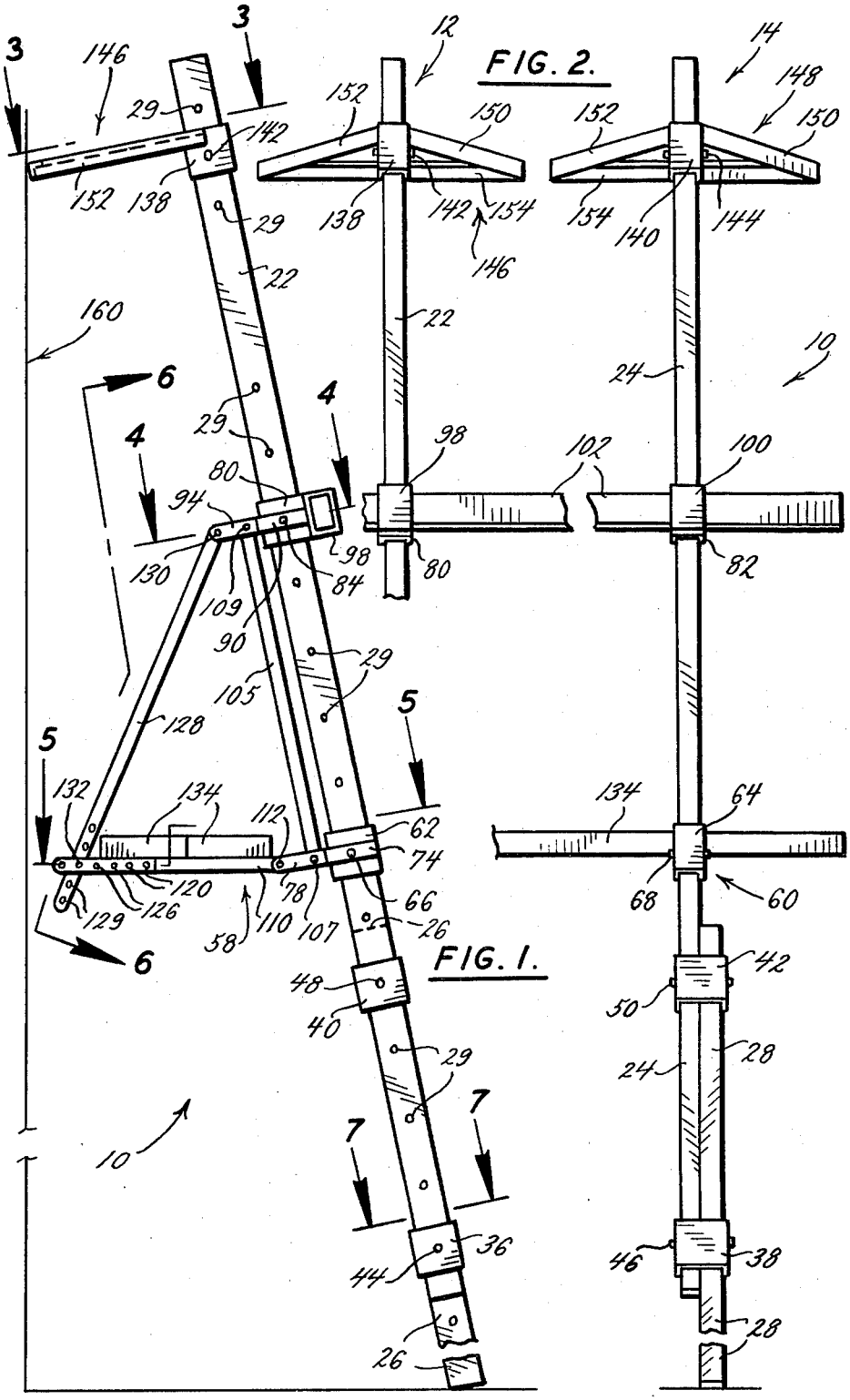
FIG. 1 is a side view of the scaffold showing the walking platform mounted upon the platform support assembly of one of the leg assemblies.
FIG. 2 is a rear view of the scaffold taken from the right side of FIG. 1 with one of the leg assemblies and with the cross rail and walking platform shown broken.

The scaffold device 10 comprises two upright assemblies 12 and 14, each having long vertical legs 22 and 24, respectively, and two lower vertical extendor beams 26 and 28, respectively, at the bottom of each leg. Centrally aligned longitudinally along the legs 22 and 24 are a plurality of equidistant transverse bores, the bores 29 being shown for the leg 22 in FIG. 1, which allow passage of a bolt for adjustment purposes as will be described. The legs 22 and 24 as well as the extendors 26 and 28 can be of two by four inch wood. Centrally aligned longitudinally along the extendors 26 and 28 are a plurality of transverse bores, such as bore 32 shown for extendor 26 in FIG. 1. The extendor bores are equidistantly spaced at the same intervals as the leg bores 29. The leg bores and the extendor bores allow adjustment of the extendors relative to the legs.

At the lower end of each leg are rectangular steel sleeves 36 and 38 adapted to telescopically receive the legs and extendors when their sides are flush against each other as shown in FIG. 7. The inside and outside walls of the sleeves 36 and 38 have aligned transverse bores to receive lock bolts 44 and 46 passing through the leg and extendor bores to hold the extendors and legs in fixed relative position. The bolts are secured by nuts to prevent them from being pulled from the sleeves.

Likewise the upper ends of the extendors are maintained flush against the sides of the legs by rectangular sleeves 40 and 42 which have bores through their side walls to receive lock bolts 48 and 50, which extend through the leg and extendor bores and are secured by nuts. With the sleeves 36, 38, 40 and 42 in place and secured by the bolts, a stable connection of the legs to the extendors exists.

Moving upwardly on the leg assemblies there are a pair of identical adjustable platform assemblies 58 and 60. Each platform assembly has lower steel sleeves 62 and 64 each adapted to telescopically receive their corresponding leg 22 and 24, and each sleeve having bores in its walls positioned to be aligned with the leg bores. As seen in FIG. 5 for one of the leg assemblies, secured to each of the lower sleeves 62 and 64 as by welds are an offset symmetrical pair of braces 72 and 74 which have bores aligned with the sleeve bores. The braces 72 and 74 extend outward into projections 76 and 78 which both have a pair of bores extending through them which are aligned for fastening purposes as will be described. Bolts 66 and 68 extend through the bores in the sleeves 62 and 64, the braces, and the legs, and are secured by nuts to hold the sleeves 62 and 64 in fixed position relative to the legs.

Located above the sleeves 62 and 64 are another pair of identical sleeves 80 and 82 which each have a rectangular cross section to telescopically receive the legs. The sleeves 80 and 82 have transverse bores to allow extension of bolts, such as the bolt 84 shown in FIG. 4 for one sleeve, to hold the sleeves in fixed position to the legs. There are a pair of symmetrical offset braces 88 and 90 secured as by welds to each of the sleeves 80 and 82. The braces have bores aligned with the bores of the sleeves 80 and 82 to receive the bolts 84. The braces 88 and 90 have extensions 92 and 94, respectively, which each have a pair of aligned transverse bores adapted to receive bolts for connecting purposes to be described. The braces have bores aligned with the bores of the sleeves 80 and 82 to receive the bolts 84.

Rectangular sleeves 98 and 100 are secured, respectively, to the back sides of sleeves 80 and 82 as by welds and extend transversely to those sleeves. Sleeves 98 and 100 telescopically receive a transverse cross rail 102 which can be a two by four inch wooden beam, and which serves as a safety handrail and as a connecting stabilizing member for the scaffold.

Returning now to the offset braces 76, 78, 92 and 94, a longitudinal connecting rod 105 has bores at its upper and lower ends which are aligned with the inner pair of brace bores as shown in FIGS. 4 and 5 so that bolts 107 and 109 extend through the brace bores and the rod bores to secure the rod to the braces with nuts at the ends of the bolts. The rod 105 thus serves to space the lower sleeve 62 and its braces from the upper sleeve 80 so that both sleeves can be slid together to allow adjustment of their positions relative to the selected leg bores. A rod similar to rod 105 spaces the corresponding sleeves for the other platform assembly 60.

With regard to the remaining portions of the platform assemblies, description will be given for one assembly which is sufficient for both, as they are identical. Referring to FIGS. 1, 4 and 5, at the lower end of the platform assembly 58, is a lower pivotal rod 110 which has at its inner end a bore which is aligned with the outer bores of the braces 76 and 78 to allow pivotal connection of the rod 110 to the braces 76 and 78 by a nut and bolt 112.

As seen in FIG. 5, the rod 110 extends outward from its pivotal connection into an offset section 116. A separate straight rod section 118 is connected to the rod 110 by nuts and bolts 120 so that it is held fixed to the rod 110. The offset 116 and the section 118 have a plurality of bores 124 and 126, respectively, which are aligned with one another so as to receive a bolt to secure between them the lower end of a rod to be described.

The upper offset braces 92 and 94 have pivotally secured to them a rod 128 which has a bore at its upper end which is aligned with the outer transverse bores of the offset braces 92 and 94, to receive a bolt 130 secured by a nut.

The lower end of the rod 128 is secured to the lower rod 110 at a desired position to allow positioning of a platform to be described. The lower end of the rod 128 has a plurality of transverse bores, one of which is aligned, as seen in FIG. 5, with a pair of the bores 124 and 126 so that a bolt 132 can extend through the aligned bores and be secured by a nut to hold the rod 128 to the offset 116 and section 118 at the desired fixed position. With the rods 110 and 128 secured, a complete and rigid platform assembly structure is formed. A platform board 134, which can be two by eight inch wood, extends transversely across the scaffold so that it is supported at each end above the rods 110 on each side of the scaffold, as illustrated in FIGS. 1, 2, 5 and 6. The platform 134 can thus be positioned according to the incline of the legs so that it is approximately parallel to the ground to present a level walking surface for various angles of inclination chosen for the legs.

At the top of each of the legs 22 and 24 are triangular spacer assemblies 146 and 148 for keeping the tops of the legs spaced from the wall of the house or other obstacle to provide greater maneuverability on the platform 134. The spacer assemblies include rectangular sleeves 138 and 140 which telescopically receive the legs. The sleeves have aligned transverse bores in their sides to allow them to be secured to the legs by bolts 142 and 144 which extend through the leg bores and through the sleeve bores to hold the legs and sleeves in fixed relationship. The triangular portion of the assemblies 146 and 148 are formed of angle iron. Referring to FIGS. 1 and 3, description of the triangle for assembly 146 will be given, which is sufficient for both assemblies, as they are identical. The triangle portion approximates an isosceles triangle, having two side legs 150 and 152 of equal length with a longer leg 154 forming the base of the triangle. Each of the legs 150, 152 and 154 is an angle iron with the lower end of the angle extending downward parallel to the legs 22 and 24 and the top side of the angle perpendicular to the legs 22 and 24. The junction of angle legs 150 and 152 with the angle leg 154 is made by cutting the angles so that when they are bent as shown in FIG. 3, and ends of the member 154 are flush with the adjacent ends of the members 150 and 152 so that the ends can be welded together. The other ends of the members 150 and 152 are welded to the sleeve 138 to provide unification with the sleeve 138.

Operation

In operation the scaffold 10 can be positioned against a structure upon which work is desired to be performed, such as the wall of a house to be painted, the wall being shown in FIG. 1 as 160. For purposes of demonstration, the operation will be given beginning with the scaffold disassembled to the extent that the triangle spacers 146 and 148 are removed from the legs, cross rail 102 is not inserted in its sleeve, the support assembly rods 110 and 128 are not connected to each other, and the platform 134 is not mounted on the rods 110. The sleeves 62, 64, 80 and 82 are mounted to the legs. The position chosen for the location of the legs 22 and 24 is of course dependent upon the type of work to be done on the structure and the degree of maneuverability desired, as well as other conditions around the structure which may dictate a certain position for the scaffold for safety or other reasons. For purposes of demonstration, the scaffold is desired to be placed against the wall 160 so that the legs 22 and 24 are at the angle shown in FIG. 1.

With the scaffold 10 is the disassembled position, the operator first positions the triangular spacer assemblies 146 and 148 at the position desired by removing the bolts 142 and 144 and aligning the bores of the sleeves 138 and 140 with the desired leg bores and then securing the sleeves in the desired position by insertion of the bolts 142 and 144 and securing them by the nuts at the position desired.

With the triangular spacers thus adjusted, the operator then positions each of the extendors 26 and 28 at a desired position relative to the legs 22 and 24. For level terrain, the extendors 26 and 28 have the same position relative to the legs 22 and 24. However, in situations involving unlevel terrain, the extendors may be placed at different relative positions to account for the discrepancy in the levels. Thus the extendor 26, for example, may be positioned so that a greater portion of its lower end extends beyond the leg 22 than the corresponding section of the extendor 28 extending below the leg 24. The extendor adjustment is of course done by removal of the bolts 44, 46, 48 and 50 and alignment of the extendor bores and the leg bores with the bores of sleeves 36, 38, 40 and 42, and then reinserting the bolts and securing them by the nuts. The extendors 26 and 28 thus give the scaffold the benefit of versatility and extra length. When the platform support assemblies cannot be positioned to the desired height by adjustment of the platform assembly sleeves alone, the extendors 26 and 28 can be adjusted to increase the height of the scaffold to accommodate the need for increased height of the platform 134.

With the extendors positioned properly, and with the platform assembly sleeves 62, 64, 80 and 82 in locked position on the legs, the pivotal rods 128 and 110 for both the platform assemblies 58 and 60 are secured together by the bolts 132 to the relative positioning desired with the rod 128 inserted between the offset 116 and the section 110 and secured. The position desired is normally one that will place the lower rod 110 approximately level with the ground. This position can be ascertained by first placing one of the leg assemblies against the walls at the angle of inclination desired for the legs and from doing this it can be ascertained which bores of the rods 128, 118 and 110 it is necessary to align and secure by the bolts 132.

Next, the cross handrail 102 is inserted through the sleeves 98 and 100, with preferably an equal length of the rail 102 extending on each side of the legs 22 and 24 for symmetrical balance. With the handrail 102 thus inserted, the legs 22 and 24 can be raised simultaneously by grabbing the arm and lifting the legs upward. If a single person is to raise the scaffold, the legs 22 and 24 can be slid together as closely as possible so that each can be grasped by the arms. The connecting rail 102 also operates to retain the relative position of the legs to one another during lifting.

The legs are raised to the upright position as shown in FIGS. 1 and 2, and the triangular spacers 146 and 148 are placed against the wall as shown in FIG. 1 to space the upper leg end outward from the wall. The positioning is such that the rods 110 are level with the ground. If the ground is dirt, the bottoms of the extendors 26 and 28 are pressed into the dirt to give better stability. If desired, an object such as a concrete block or the like can be placed on the ground on the outside of the extendor to keep the extendor from moving. However, the weight of the person on the scaffold platform is sufficient in most cases to maintain stable erection of the scaffold.

The platform 134 is grasped by the operator and its ends are placed above the rods 110 of each of the platform assemblies 58 and 60 preferably with equal length of the platform extending on either side of the legs 22 and 24. If the platform 134 cannot be mounted by the operator because of the height of the rods 110, a ladder or box or other structure can be used so that the operator can climb upon it to mount the platform. With the platform 134 installed as shown in FIG. 1, the operator can then climb upon the platform and place objects such as a paint bucket or tools on the platform to be used in the work done upon the structure 160. The climbing upon the platform 134 can be accomplished by a stool, ladder or other object which the operator can use to elevate himself.

If desired, the platform 134 can be inserted within the locked assemblies 58 and 60 before the legs are erected. Two or more persons can work upon the platform 134 and of course the number of persons who can operate upon the platform is dependent upon the space between the two legs 22 and 24 and also upon the strength of the materials used for the legs, platform and other members.

In operation, the persons on the scaffold can work next to the wall 160 and can operate on the inside of the legs 22 and 24 as the support assemblies 58 and 60 are located on the inside rather than the outside of the legs. The triangle spacers 146 and 148 allow upper maneuverability for the workers, as can be seen in FIG. 1, and the workers can get quite close to the structure upon which work is being performed. The rail 102 acts as a safety rail so that the workers can hold onto it when they desire and also should one of the workers lean backward, he will lean upon the rail 102 and will not fall. The rail 102 also acts to provide stability because, as it is telescopically received in the sleeves 98 and 100, the legs 22 and 24 do not tilt relative to each other. The rail 102 can also act as a means to hang things like a work box, or other devices needed in work.

In disassembling the scaffold, the workers first dismount from the platform 134 by means of a ladder, stool or other descension means. The platform 134 is then slid off the rails 110 of each of the platform assemblies so that it is removed from the assemblies. After the platform 134 is dismounted, the legs 22 and 24 can be slid close to each other so that they can both be gripped by a single operator at which point the operator can pull the legs away from the wall 160, and as he moves away from the wall, he can gradually lower the legs and lay the scaffold upon the ground. This of course can be done more easily by two operators, each grasping one of the legs. After the scaffold is lowered, the cross rail 102 can be slid out of the sleeves 98 and 100. If desired, the scaffold can be lowered with the platform on the assemblies 58 and 60. For storage purposes, the bolt 132 can be removed to disengage the rods 128 from the rods 110 and 118, and those rods can be folded toward the legs into alignment with the rods 105. The sleeves 138 and 140 can be disengaged from the legs 22 and 24 by removal of the bolts 142 and 144 to remove the triangle spacer assemblies 146 and 148. The extendors 26 and 28 can also be disengaged from the legs 22 and 24 by removal of the bolts and sleeves that secure them to the legs. Likewise, the sleeves 62, 64, 80 and 82, and the rest of the platform assemblies can be removed by removing the bolts that hold those sleeves to the legs.

There has thus been described a novel scaffold convenient in use, providing safety in operation, and maneuverability of the workers, yet having a minimum of members necessary to carry out such objectives.

Various changes and modifications may be made within this invention as will be readily apparent to those skilled in the art. Such changes and modifications are within the scope and teaching of this invention as defined by the claims appended hereto.

The dimensions of 2 inches ×4 inches are 5.08 cm ×10.16 cm, and the dimensions of 2 inches ×8 inches are 5.08 cm ×20.32 cm.

What is claimed is:

1. A scaffold device for supporting humans above the ground by a walking platform, comprising:

(a) a pair of single individually supported upright longitudinal legs for leaning at various angles against a structure, each said leg having a plurality of longitudinal holes for adjustable support of the platform; and (b) platform support means positionable on each leg for supporting the platform on the side of the legs nearest the structure, each said support means comprising an assembly, each assembly comprising:

(i) a lower member having an inner end adjustably pivotally mounted by a first lock member to a corresponding leg to be held in fixed position against linear movement relative to its corresponding leg, said first lock member extending through a selected leg hole, said lower member extending outwardly from its corresponding leg to supportingly engage the platform, and (ii) an upper member having an inner end adjustably mounted by a second lock member to its corresponding leg to be held in fixed position against linear movement relative to its corresponding leg, said second lock member extending through a selected leg hole, and the upper member extending outwardly and downwardly from its leg to adjustably engage and hold the lower member in a selected position.

2. The structure of claim 1 further comprising a rigid structural member connecting the inner end of each upper member and the inner end of each lower member to supportingly hold them in fixed relationship relative to each other and to resist linear movement of said inner ends of the upper and lower members relative to each other.

3. The structure of claim 1, wherein the preamble further includes a cross rail, and wherein the structure further comprises means for connecting the cross rail adjacent each leg to limit relative movement between the legs.

4. The structure of claim 1 or 2 further comprising a pair of spacers, each spacer connected to the upper end of a corresponding leg at a point above the upper support member, and extending outwardly from the leg to engage the side of the structure to space the upper leg end from the structure and increase the angle of inclination of the leg towards the vertical position relative to the ground.

5. The structure of claim 1 further comprising a pair of extendor members each adjustably secured to the lower portion of each leg to adjust the position of the lower end of each leg relative to the ground.

6. A scaffold device for supporting humans above ground by a walking platform comprising:

(a) a pair of single individually supported upright longitudinal legs for leaning at various angles against a structure, each said leg having a plurality of holes for adjustably supporting the platform;

(b) platform support means positionable on each leg for supporting the platform on the side of the legs nearest the structure, comprising a pair of support assemblies, each assembly comprising:

(i) a lower member having an inner end and an outer end;

(ii) an upper member having an inner end and an outer end;

(iii) an upper mounting sleeve and a lower mounting sleeve each sized to telescopically receive a corresponding leg, each said mounting sleeve having holes therethrough for alignment with a selected hole in a corresponding leg;

(iv) means for pivotally mounting the inner ends of the lower member and upper member to their corresponding upper and lower sleeves to hold the inner ends against linear movement relative to the sleeves;

(v) an upper locking member and a lower locking member for extending respectively through the upper sleeve holes and lower sleeve holes and through aligned corresponding leg holes to hold said upper and lower mounting sleeves in fixed relationship against movement relative to their corresponding leg;

(vi) a rigid connecting member fixedly connected to the upper mounting sleeve and lower mounting sleeve to hold the upper and lower sleeves in fixed relationship to each other; and (vii) means for locking the outer ends of the upper and lower members to each other to hold the said outer ends in fixed relationship with each other.

7. The structure of claim 6 further comprising spacer members secured to each of said legs at positions above the connection of said upper sleeves and extending outwardly from the legs to engage the structure and position the legs to increase the angle of inclination of the legs relative to the ground.

8. The structure of claim 7 further comprising a cross rail connected adjacent the legs to limit relative tilting movement between the legs, said cross rail being connected to said legs to be locked against pivotal movement relative to said legs.

9. The structure of claim 8 further comprising a pair of adjustable extendor beams each having a plurality of longitudinal locking holes and each mounted to the lower portion of a corresponding leg by extendor sleeves which telescopically receive each leg, each extendor sleeve having holes therethrough so that an extendor locking member can extend through the extendor sleeve holes, selected leg holes, and selected extendor holes to hold the extendor beams in fixed relationship to the leg.

* * * * *